United States Patent [19]

Yokota et al.

[11] Patent Number: 4,979,838

[45] Date of Patent: Dec. 25, 1990

[54] RECEIPT CUTTING MECHANISM FOR DOT MATRIX PRINTER

[75] Inventors: Katsuyoshi Yokota, Kamakura; Ryuji Yamazaki, Isehara, both of Japan

[73] Assignee: NCR Corporation, Dayton, Ohio

[21] Appl. No.: 385,338

[22] Filed: Jul. 24, 1989

[30] Foreign Application Priority Data

Sep. 16, 1988 [JP] Japan ..... 62-230160

[51] Int. Cl.[5] ..... B41J 11/70

[52] U.S. Cl. ..... 400/621; 101/226

[58] Field of Search ..... 400/621, 621.1, 611; 101/224, 226; 83/483, 487, 485, 471.2, 488, 614

[56] References Cited

U.S. PATENT DOCUMENTS

| | | | |
|---|---|---|---|
| 3,319,500 | 5/1967 | Wild et al. | 83/487 |
| 3,984,211 | 10/1976 | Hawkins . | |
| 4,086,835 | 5/1978 | Frederick . | |
| 4,355,794 | 8/1982 | Costigan | 83/487 |
| 4,383,458 | 5/1983 | Kitai et al. . | |
| 4,401,001 | 8/1983 | Gerber et al. | 83/483 |
| 4,504,162 | 3/1985 | Speraggi | 400/621 |
| 4,691,605 | 9/1987 | Vanetik et al. | 83/485 |
| 4,701,063 | 8/1987 | Wysk et al. | 400/621 |
| 4,864,906 | 8/1989 | Hall | 83/487 |

*Primary Examiner*—Edgar S. Burr
*Assistant Examiner*—Joseph R. Keating
*Attorney, Agent, or Firm*—Wilbert Hawk, Jr.; Albert L. Sessler, Jr.; George J. Muckenthaler

[57] ABSTRACT

A receipt cutting mechanism includes a round knife or blade which is positively and rotatably driven and which engages with a fixed knife edge as the round knife travels across the printer on a driven carriage. The positive drive includes a gear cluster arrangement operated by a toothed belt which is stretched across the printer. The round knife is maintained in engagement with the fixed knife edge by means of a torsion spring tending to rotate the knife and its support in one direction.

18 Claims, 5 Drawing Sheets

RECEIPT CUTTING MECHANISM FOR DOT MATRIX PRINTER

BACKGROUND OF THE INVENTION

In the field of printing, the most common type printer has been the printer which impacts against record media that is caused to be moved past a printing line or line of printing As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like record media while the carriage and print head are moved above and across the form or like record media in the horizontal direction.

Further, in the wire matrix printer which is utilized for receipt, slip and journal printing operations, the individual print heads may be vertically oriented and printing performed by means of the print wires moving downwardly to impact on the record media. Alternatively, the individual print heads may be horizontally oriented and printing performed by means of the print wires moving horizontally to impact on the record media. A preferred number of four of such individual print heads is common in known arrangements. The dot matrix printer is commonly used in an electronic cash register (ECR) or in a point of sale (POS) terminal.

In the dot matrix printer, there is a requirement for one or more small electric motors to drive certain parts of the printer. A small motor is used to drive the print head carriage in reciprocating manner in the printer that includes a stationary platen and a movable print head. The print head carriage and the associated print head are moved to appropriate and precise locations along the line of printing for dot matrix printing of alpha numeric characters or of graphics type characters. A second motor is used to drive the paper such as a receipt, a slip or a journal at the end of the printing operation and which paper drive is usually performed at the end of each line of printing. However, it is feasible to advance the paper at the end of the printing on a line without the necessity of moving the carriage and print head to the end of such line. This arrangement enables faster printing operation.

Additionally, in the dot matrix printer which is used for receipt, slip and journal printing operations, the receipt paper is cut after each receipt transaction and a receipt is given to the customer. The device for cutting the receipt paper has commonly been a tool, a blade or a cutter wheel.

Representative documentation in the field of cutting devices includes U.S. Pat. No. 3,984,211, issued to J. H. Hawkins on Oct. 5, 1976, which discloses a circular knife on a carriage and drive means for the knife and the carriage. A chain is meshed with sprocket wheels that are coupled to the knife for rotating thereof.

U.S. Pat. No. 4,086,835, issued to C. S. Frederick on May 2, 1978, discloses a reciprocable carriage with a rotary knife. The carriage includes sprockets engageable by a chain to rotate the knife simultaneously with movement of the carriage.

U.S. Pat. No. 4,383,458, issued to M. Kitai et al. on May 17, 1983, discloses a carriage moved along a guide rod by a chain, the motion of the chain being converted into rotary motion of a rotary blade via an intermediate wheel and a drive wheel.

U.S. Pat. No. 4,701,063, issued to H. J. Wysk et al. on Oct. 20, 1987, discloses a rotary cutter cooperating with a cutting edge. A cam is used to move the cutter into and out of engagement with the cutting edge and a spring biases the cutter against the edge.

SUMMARY OF THE INVENTION

The present invention relates to a dot matrix printer for impact printing on record media. The dot matrix printer includes two separate printing stations, one station positioned near the front of the printer and the other station positioned rearwardly of the one station. The two stations are arranged in tandem manner and the two separate print head carriages are coupled to a drum cam type drive mechanism positioned between the two carriages. The two carriages along with the associated print heads are driven by the drum cam type drive mechanism in equal and opposite directions during printing operations.

The one station near the front of the printer is utilized for dot matrix printing on a receipt and on a slip or like business form and is referred to as the receipt/slip station. The other station rearwardly of the one station is utilized for dot matrix printing on a journal and is referred to as the journal station. A plurality of solenoid driven, single wire print heads are supported in spaced relationship on each carriage for performing the printing operations at the two printing stations.

A single drum type cam drive is positioned between the receipt/slip station and the journal station. The drum cam includes a rail on the periphery thereof which engages with a pair of rollers on each print head carriage. Rotation of the drum cam in a predetermined direction causes the receipt/slip print head carriage to move in one direction across the printer and causes the journal print head carriage to move an equal distance in the opposite direction.

A receipt paper roll is disposed rearwardly and downwardly of the receipt/slip station and receipt paper is driven across the platen for printing on the paper. A knife mechanism is provided at the front of the printer for cutting the receipt paper after printing thereon. The printer also includes a slip table positioned for receiving a slip for printing thereof at the receipt/-slip station.

In accordance with the present invention, there is provided a receipt cutting mechanism for a dot matrix printer comprising an elongated member having an edge portion and disposed across the printer, a carriage adjacent said elongated member and driven across the printer in reciprocating manner, a round blade operably associated with the edge portion of said elongated member, and rotational drive means including a toothed member extending across said printer and a pair of pulleys engaging with said toothed member and rotatably driven thereby, said drive means also including a plurality of gears coupled with said toothed member and with said round blade for rotatably driving said round blade along said edge portion and cutting a receipt from receipt paper disposed across said elongated member.

In view of the above discussion, a principal object of the present invention is to provide an improved cutting mechanism for a dot matrix printer.

Another object of the present invention is to provide a cutting mechanism which is constructed to be positively driven across the dot matrix printer.

An additional object of the present invention is to provide a round cutting blade wherein the entire cutting surface of the blade is utilized.

A further object of the present invention is to provide a cutting mechanism having a rotational drive means which includes toothed elements for moving the cutting blade across the printer and for rotationally driving the cutting blade.

Additional advantages and features of the present invention will become apparent and fully understood from a reading of the following description taken together with the annexed drawing.

DESCRIPTION OF THE PREFERRED EMBODIMENT

Figure 1:
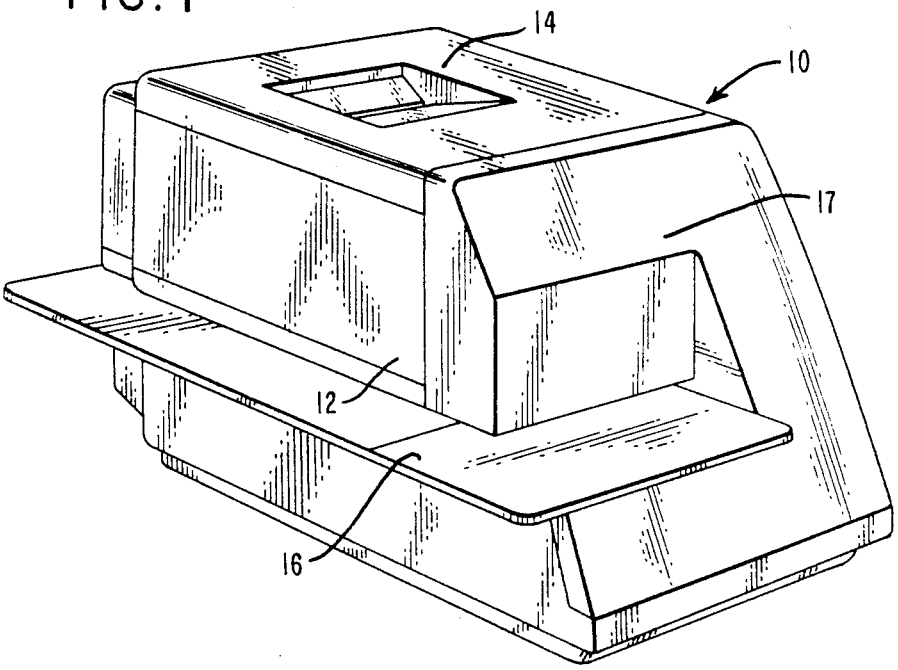
FIG. 1 is a perspective view of a dot matrix printer incorporating the subject matter of the present invention.

Referring now to FIG. 1, a printer 10 is designed as a two station, receipt/slip and journal printer. The receipt/slip printing station occupies a front portion 12 and the journal printing station occupies a rearward portion 14 of the printer. A slip table 16 is provided along the left hand side of the printer 10. A front cover 17 swings toward the right to expose certain operating parts of the printer 10.

Figure 2:
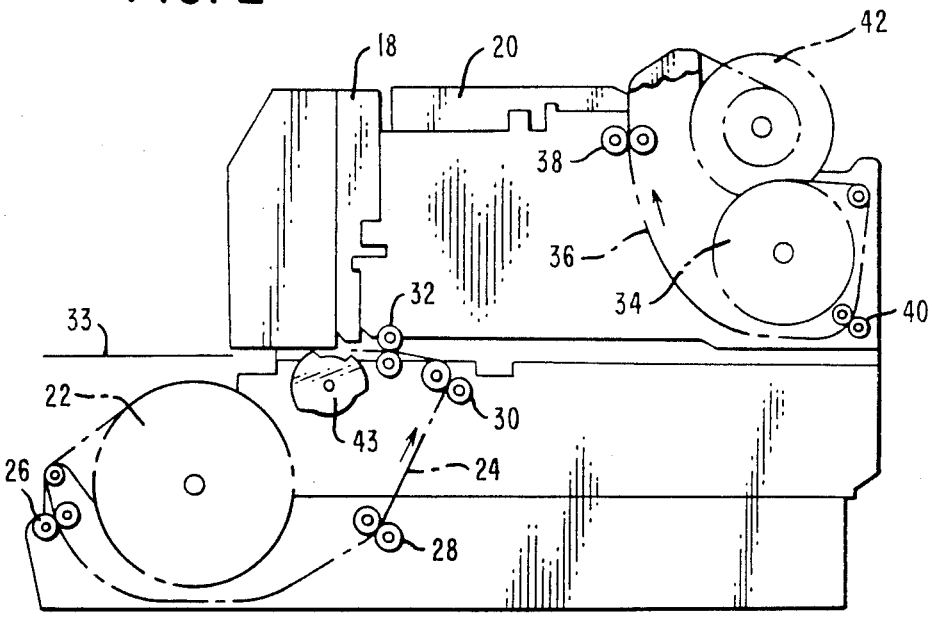
FIG. 2 is a right side elevational view in diagrammatic form showing the arrangement of certain elements of the printer.
Figure 3:
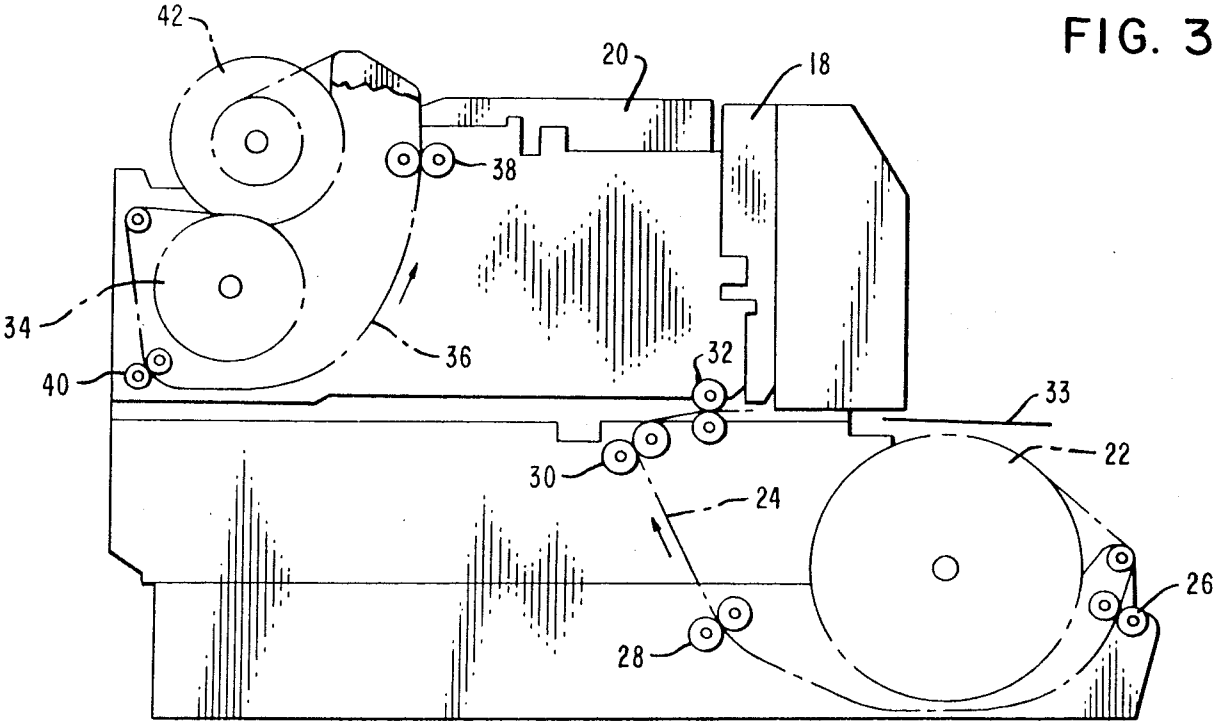
FIG. 3 is a left side elevational view in diagrammatic form showing the arrangement of such certain elements of the printer.

FIGS. 2 and 3 are right and left side elevational views and show certain elements of the printer 10 in diagrammatic form. The receipt/slip portion 12 and the journal portion 14 include individual print wire solenoids (not shown) along with a ribbon cassette 18 for the receipt/-slip printing station operation and a ribbon cassette 20 for the journal printing station operation. A roll 22 of receipt paper is journaled at the front of the printer and the receipt paper 24 is driven and guided by appropriate pairs of rollers, as 26, 28, 30 and 32 in a path past the receipt/slip printing station for printing operation and for issuance of a receipt 33 after cutting thereof from the receipt paper 24. A supply roll 34 of journal paper is positioned in a cradle at the rear of the printer 10 and the journal paper 36 is driven and guided by appropriate pairs of rollers, as 38 and 40, in a path from the supply roll 34, past the journal printing station, and onto a take-up roll 42. A timing plate 43 (FIG. 2) is provided at the receipt/slip printing station for positioning the receipt/slip feed rolls.

Figure 4:
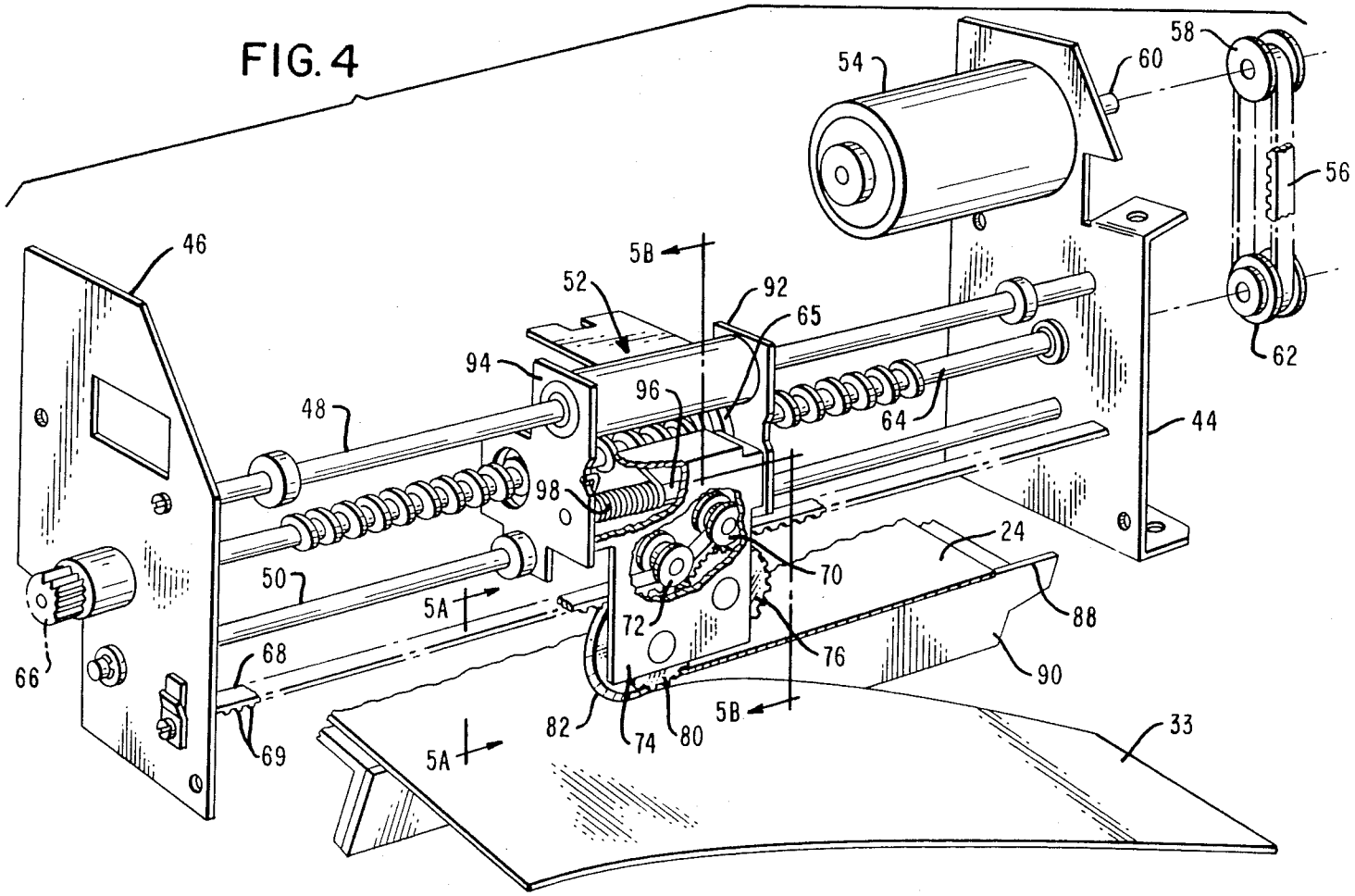
FIG. 4 is a perspective view, taken from the front and left side, of a portion of the dot matrix printer illustrating the parts of the cutting mechanism.

FIG. 4 is a perspective view of the receipt cutting mechanism according to a preferred embodiment of the present invention. A right side plate 44 and a left side plate 46 provide support for the receipt cutting mechanism. A pair of shafts 48 and 50 are secured to the side plates 44 and 46 and provide support for a carriage 52 that is slidably moved along the shafts 48 and 50 in transverse direction on the printer 10. The carriage 52 is driven in such transverse direction by means of a reversing-type motor 54 which is suitably supported by the right side plate 44. A toothed belt 56 is trained around a pulley 58 on the end of a motor shaft 60 and around a pulley 62 on the end of a lead screw-type drive shaft 64. The drive shaft 64 is coupled by means of a threaded hub 65 associated with the carriage 52 for driving thereof across the printer 10. A knob 66 is secured to the left end of the shaft 64 to be used for turning the shaft in case of a jam or for manually moving the carriage 52 to a desired position.

A belt or like resilient member 68 with teeth 69 is stretched across the printer parallel to the shafts 48 and 50 and is secured to the side plates 44 and 46 by suitable means. A pair of rollers 70 and 72 are journaled on a bracket 74 secured to the carriage 52 and are positioned in offset manner to engage with the smooth side of the toothed belt 68. A toothed gear 76 is also journaled on the bracket 74 on the carriage 52 and is positioned under the rollers 70 and 72 to mesh with the toothed belt 68. The rollers 70 and 72 are positioned at different levels relative to the toothed belt 68 and to the toothed gear 76 in order to provide positive contact of the teeth 69 of the belt 68 with the gear 76. A second toothed gear 78 is disposed adjacent and is journaled coaxially with the toothed gear 76 and rotates therewith. The toothed gear 78 engages and meshes with a third toothed gear 80 which is also journaled on the bracket 74.

Figure 5:
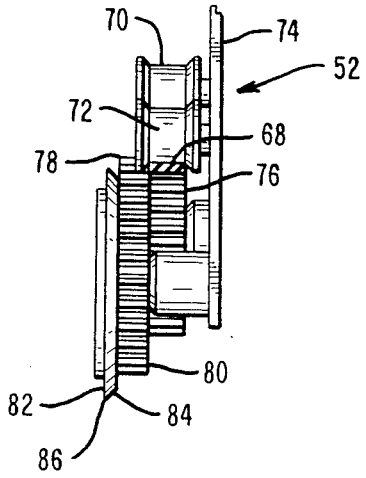
FIG. 5 is a left side elevational view showing the arrangement of the cutting mechanism.

A circular cutting knife or blade 82 is disposed adjacent and is journaled coaxially with the toothed gear 80 and rotates therewith. The cutting blade has an angled cutting surface 84 with an edge 86 arranged to engage with and contact an edge 88 (FIG. 4) of a fixed blade 90 supported in secure manner across the printer 10. FIG. 5A is a left side view illustrating parts of the arrangement of the carriage 52, the toothed belt 68, the rollers 70 and 72, the gears 76, 78 and 80, and the cutting blade 82 in contact with the fixed blade 90 (FIG. 4). FIG. 5B is a right side view illustrating the arrangement of the rollers 70 and 72, the gears 76, 78 and 80, and the cutting blade 82. The gear 76 is positioned to mesh with the teeth 69 on the lower side of the toothed belt 68 and to cooperate with and to be positively driven by the teeth 69 in response to pressure by the rollers 70 and 72 against the belt 68. The different levels of the two rollers 70 and 72 ensure a positive driving force of the gear 76 and of the intermediate gears 78 and 80 and of the cutting blade 82.

When the carriage 52 is driven in transverse direction for receipt cutting operation, the teeth 69 on the belt 68 engage with the teeth on gear 76 to rotate such gear. When the carriage 52 is driven to the left, as seen in FIG. 4, the gear 76 is rotated in the clockwise direction. Since the gear 78 is coaxial and on the same shaft as the gear 76, gear 78 is rotated in the clockwise direction. Gear 80, meshing with gear 78, is rotated in the counterclockwise direction. Since the cutting blade 82 is coaxial and on the same shaft as the gear 80, the blade 82 is rotated in the counterclockwise direction. In this regard, when the carriage 52 moves to the left (FIG. 4), the blade 82 rotates counterclockwise which provides an increased cutting force. If the blade 82 rotates clockwise, the cutting force is reduced.

Figure 6:
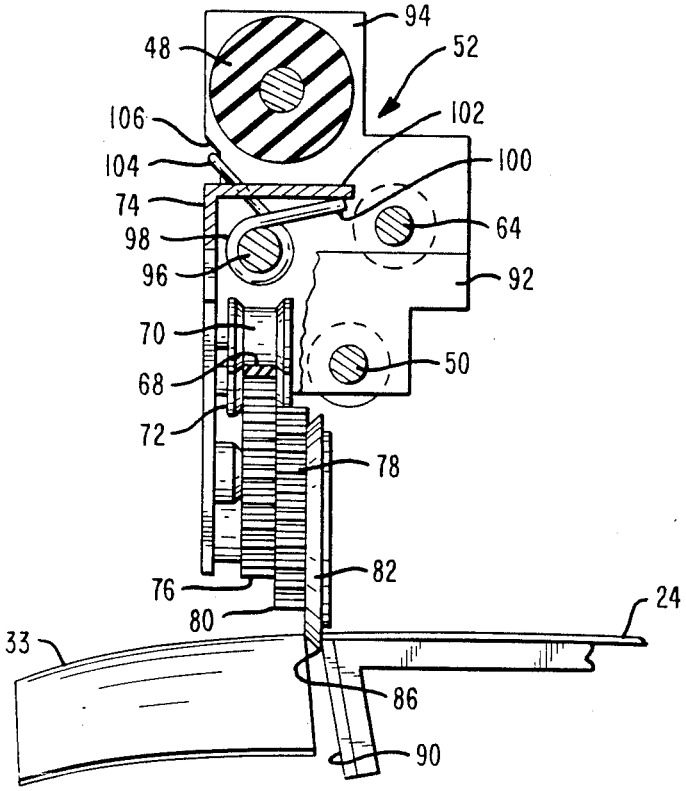
FIG. 6 is a right side elevational view showing the arrangement of the cutting mechanism.

FIG. 6 shows the carriage 52 with the bracket 74 supporting the rollers 70 and 72, the gears 76, 78 and 80 and the cutting blade 82. As seen in FIG. 4, the carriage 52 includes a right side plate 92 and a left side plate 94. The support bracket 74 is constructed to be pivotable on a pivot member 96 which is journaled in the side plates 92 and 94. A coil spring 98 is placed on the pivot member 96 and one end 100 of the spring 98 is in contact with the lower surface of an upper portion 102 of the support bracket 74. The other end 104 of the spring 98 is in contact with an angled surface portion 106 of the carriage 52. The coil spring 98 is arranged to provide an urging or biasing force on the support bracket 74 in the counterclockwise direction (FIG. 6) relative to the position of the carriage 52. The urging force of the spring 98 causes the edge 86 of the cutting blade 82 to bear against the edge 88 of the fixed blade 90 and to ensure engagement of the edges 86 and 88.

It is possible that the support bracket 74 may rotate or pivot a slight amount in the clockwise direction (FIG. 6) by reason of foreign matter sticking to the surface of the receipt paper 24. In order to alleviate this condition, the toothed belt 68 is made of relatively soft material to ensure firm engagement of the gear 76 with the teeth 69 of the belt 68. An alternative to the belt 68 is a metallic rail with teeth firmly engaged with an appropriately positioned gear for driving the cutting blade 82.

The rotating velocity of the cutting blade 82 can be made adjustable dependent upon the kind and thickness of the receipt paper 24, and dependent upon wearing of the cutting blade 82 caused by rotation of the blade while in contact with the fixed blade 90. It is also within the concept of the present invention to rotate the cutting blade 82 at a velocity which corresponds to a resulting velocity that is the same as or is slightly faster than a velocity corresponding to the transverse moving speed of the carriage 52. The gear ratio of the associated gears may be changed to change the rotational velocity of the cutting blade 82. An alternative to the intermediate gears is the use of pulleys and a connecting belt to drive the cutting blade 82 in rotational manner. Further, an alternative to the lead screw-type drive shaft 64 is the use of a linear pulse motor to move the carriage 52.

Figure 7:
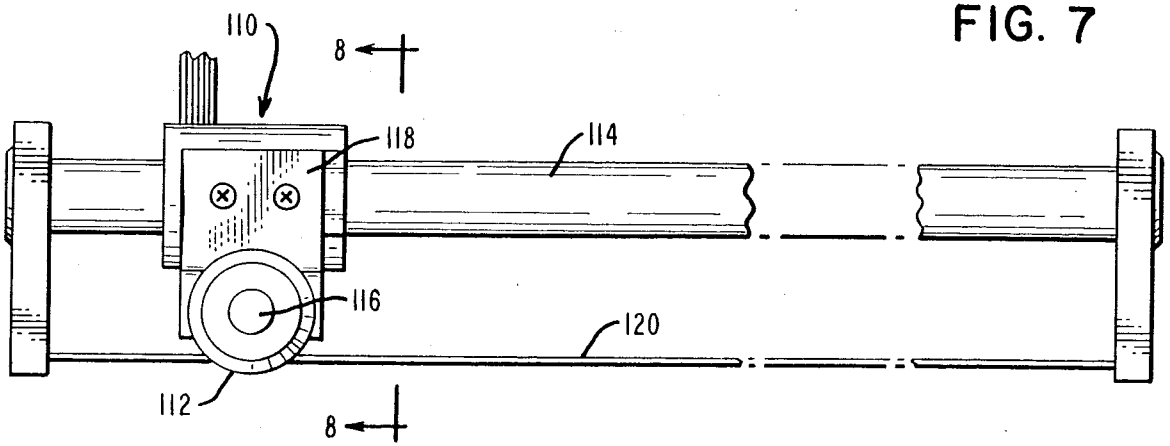
FIG. 7 PRIOR ART
FIG. 7 is a front view of a conventional cutting mechanism.
Figure 8:
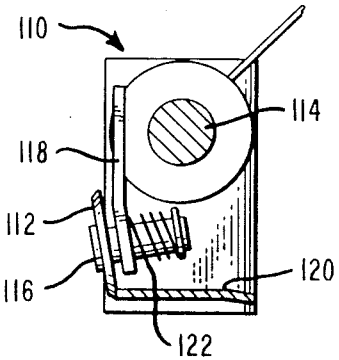
FIG. 8 PRIOR ART
FIG. 8 is a side view, partly in section, taken on the line 8—8 of FIG. 7

FIGS. 7 and 8 are a front view and a side view, respectively, of a conventional arrangement for cutting receipt paper. A carriage 110 is provided with a round blade 112 that is driven in the horizontal direction along a guide member 114. The round blade 112 is journaled on a shaft 116 supported on a bracket 118 and the round blade is urged against a fixed blade 120 by a spring 122 on the shaft 116. A receipt (not shown) is cut off by the round blade 112 upon horizontal movement of the carriage 110. It is seen that the round blade 112 is rotated only by frictional force generated during a receipt cutting operation. If foreign material slows or stops the rotation of the blade 112, a smooth cutting operation is not possible, and uneven rotation of the blade 112 causes wearing of such blade.

The present invention provides a positive drive for the cutting blade so that the cutting operation is certain and smooth even though foreign material may be present in the cutting area. As a result, the entire cutting surface of the blade 82 is used in the receipt cutting operation so that wearing is reduced and a predetermined cutting force can be maintained for a longer period of time. If desired, the cutting force can be increased to ensure a smoother cutting operation.

It is thus seen that herein shown and described is a compact dot matrix printer that includes a receipt cutting mechanism, wherein the cutting blade is caused to be rotated by the external driving force that is used to move the cutting blade carriage. The cutting mechanism provides for superior cutting operation, for even wearing of the blade, and for maintaining a constant cutting force over a period of time. The apparatus and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A receipt cutting mechanism for a dot matrix printer having side frame portions, said mechanism comprising a carriage driven in reciprocating manner across said printer, motor means for driving said carriage across said printer, a fixed blade member positioned between and supported by said side frame portions, a rotatable cutting blade operably associated with said fixed blade for cutting a record medium to provide a receipt of a printing transaction, belt means having two ends, with one end fixedly connected to each of said side frame portions and gear means driven by said belt means responsive to movement of said carriage for rotating said cutting blade in response to movement of said carriage across said printer, support means coupled to said carriage for supporting said cutting blade in position for cutting said receipt as said carriage is driven across the printer, and spring means coupled with said support means and with said carriage for biasing said cutting blade against said fixed blade member for ensuring cutting of said record medium.

2. The receipt cutting mechanism of claim 1 wherein said carriage includes spaced side plates for containing said rotatable cutting blade.

3. The receipt cutting mechanism of claim 1 wherein said means for driving said carriage includes a lead screw journaled in said side frame portions.

4. The receipt cutting mechanism of claim 1 wherein the belt means connected to the side frame portions includes a toothed resilient member stretched across the printer and engaged with said gear means.

5. The receipt cutting mechanism of claim 4 including roller means engageable with said toothed resilient member for biasing thereof into engagement with said gear means.

6. The receipt cutting mechanism of claim 1 wherein said support means coupled to said carriage for supporting said cutting blade includes a bracket for journaling said gear means and said cutting blade.

7. The receipt cutting mechanism of claim 1 wherein said spring means for biasing said cutting blade comprises a coiled spring having one end thereof engaged with the carriage and the other end engaged with the cutting blade support means.

8. The receipt cutting mechanism of claim 5 wherein said roller means comprise a pair of spaced rollers journaled on said cutting blade supporting means and positioned in offset manner for urging said toothed resilient member into engagement with said gear means.

9. The receipt cutting mechanism of claim 4 wherein said gear means includes a first gear engaged with said toothed resilient member, a second gear coaxial with said first gear, and a third gear spaced from and meshing with said second gear and coaxial with said cutting blade for rotating thereof.

10. In a dot matrix printer having spaced side frames and a cutting mechanism for cutting receipt paper to enable issuing a receipt after a receipt printing transaction, the improvement comprising a carriage driven in reciprocating manner across said printer, motor means for driving said carriage across said printer, a fixed member supported by said spaced side frames, a rotatable cutting member carried by said carriage and operably associated with said fixed member for cutting a receipt from said receipt paper upon driving said carriage across said printer, and belt means having two ends, with one end fixedly connected to each of said spaced side frames and gear means driven by said belt means responsive to movement of said carriage for rotating said cutting member in response to driving of said carriage across said printer.

11. In the dot matrix printer of claim 10 including a bracket connected to said carriage for supporting said rotatable cutting member in position for cutting said receipt.

12. In the dot matrix printer of claim 11 including resilient means engaged with said bracket and with said carriage for biasing said rotatable cutting member against said fixed member for ensuring cutting of said receipt paper.

13. In the dot matrix printer of claim 10 wherein said means for driving said carriage includes a lead screw journaled in said spaced side frames.

14. In the dot matrix printer of claim 10 wherein said belt means connected to said spaced side frames includes a toothed resilient member stretched across the printer and engageable with said gear means.

15. In a dot matrix printer of claim 14 including roller means engaged with one side of said toothed resilient member for biasing the toothed side thereof into engagement with said gear means.

16. In the dot matrix printer of claim 15 wherein said roller means comprise a pair of spaced rollers coupled with said carriage and journaled thereon and positioned in offset manner at different levels for urging said toothed resilient member into engagement with said gear means.

17. In the dot matrix printer of claim 14 wherein said gear means includes a first gear engaged with the toothed side of said toothed resilient member, a second gear coaxial with said first gear, and a third gear spaced from and meshing with said second gear to be driven thereby and coaxial with said rotatable cutting member for rotating thereof.

18. In the dot matrix printer of claim 13 wherein said carriage includes spaced side plates and one of said side plates includes a threaded member for engagement by said lead screw for driving said carriage.

* * * * *

UNITED STATES PATENT AND TRADEMARK OFFICE

CERTIFICATE OF CORRECTION

PATENT NO. : 4,979,838

DATED : Dec. 25, 1990

INVENTOR(S) : Katsuyoshi Yokota

It is certified that error appears in the above-identified patent and that said Letters Patent is hereby corrected as shown below:

Column 8, line 31, "engageable" should be --engaged--.

Signed and Sealed this

Eighth Day of September, 1992

*Attest:*

DOUGLAS B. COMER

*Attesting Officer*

*Acting Commissioner of Patents and Trademarks*